US005458282A

United States Patent [19]

Martin

[11] Patent Number: 5,458,282

[45] Date of Patent: Oct. 17, 1995

[54] CARD HAVING MAGNETIC SHEET SECURED TO ONE SURFACE

[75] Inventor: John J. Martin, Louisville, Ky.

[73] Assignee: Crane Productions, Inc., Louisville, Ky.

[21] Appl. No.: 915,537

[22] Filed: Jul. 20, 1992

[51] Int. Cl.[6] ..... B42D 15/02

[52] U.S. Cl. ..... 229/92.8; 283/56

[58] Field of Search ..... 229/92.8; 283/56

[56] References Cited

U.S. PATENT DOCUMENTS

| | | | |
|---|---|---|---|
| 1,264,795 | 4/1918 | Hill | 229/92.8 |
| 2,805,816 | 9/1957 | Morgan | 229/92.8 |
| 4,887,763 | 12/1989 | Sano | 229/92.8 |
| 4,957,311 | 9/1990 | Geisenheimer | 283/56 |
| 5,036,310 | 7/1991 | Russell | 340/569 |
| 5,085,470 | 2/1992 | Peach et al. | 283/58 |

*Primary Examiner*—Stephen P. Garbe

*Attorney, Agent, or Firm*—Middleton & Reutlinger; James C. Eaves, Jr.

[57] ABSTRACT

A card fabricated of a flexible material such as paper, pasteboard, plastic and the like that has a first planar surface and a second planar surface. The card is formed with a line of perforations or a fold line dividing the card into first and second sections and a thin, flexible, magnetic sheet material is adhesively secured to one of the planar surfaces of one of the sections. The thin, flexible, magnetic sheet is dimensionally coextensive with the section to which it is attached. Indicia is printed on the exposed surface of the card section to which the magnetic sheet is secured.

12 Claims, 6 Drawing Sheets

CARD HAVING MAGNETIC SHEET SECURED TO ONE SURFACE

BACKGROUND OF THE INVENTION

The present invention relates to cards such as post cards, greeting cards, advertising cards and the like, and more particularly to such cards having a magnet for removably attaching the card to a magnetic surface for display of the card and for removal or separation of the magnet from the card for use separate from the card and which magnet can be removed or separated for use separate from the card.

There are no cards, such as greeting cards, post cards, advertising cards, and the like, known to me which include a magnetic material which can be used to attach the card to a magnetic surface for displaying the card.

SUMMARY OF THE INVENTION

In one embodiment, the present invention provides a card having a magnet on one surface thereof for attachment to a metallic surface so that the card can be displayed.

The present invention further provides a card of the class described, wherein the card has first and second planar surfaces and is formed with perforations dividing the card into first and second sections and providing for the separation of the first section from the second section, and has a thin, flexible, magnetic sheet material secured to one planar surface of one of the sections.

The present invention also provides a card of the class described immediately above, wherein the thin, flexible, magnetic sheet material is dimensionally coextensive with the section of the card to which it is secured.

More particularly, in one embodiment, the present invention provides a card comprising a planar blank having a first planar surface and a second planar surface, at least one line of perforations extending across the planar blank dividing the planar blank into first and second sections providing for the separation of the first section from the second section, and a thin, flexible, magnetic sheet material adhesively secured to the first planar surface of the first section.

Also, in another embodiment, the present invention provides a card comprising a planar blank having a first planar surface and a second planar surface, a magnetized label removably attached to the card comprising a first sheet of vinyl having a front surface and a back surface with a pressure sensitive adhesive coating the front surface, a sheet of flexible magnetic material having a front surface and a back surface, geometrically identical to the first sheet, and the magnetic sheet overlaying the first vinyl sheet with the back surface of the magnetic sheet in contact with the front surface of the first vinyl sheet so that the magnetic sheet is adhesively secured to the front surface of the first vinyl sheet, a sheet of tape having a front surface and a back surface with adhesive coating both the front and back surfaces, geometrically identical to the sheet of flexible magnetic material, the sheet of tape overlaying the magnetic sheet with the back surface of the sheet of tape in contact with front surface of the magnetic sheet so that sheet of tape is adhesively secured to the magnetic sheet, and a second sheet of vinyl having a front surface and a back surface, geometrically identical with the sheet of tape, indicia printed on the second sheet of vinyl, the second sheet of vinyl overlaying the sheet of tape with the back surface of the second vinyl sheet in contact with the front surface of the sheet of tape so that the second vinyl sheet is adhesively secured to the sheet of tape, and a third sheet of vinyl having a front surface and a back surface with a pressure-sensitive adhesive coating on the back surface, the back surface of the third vinyl sheet being disposed in contact with the first planar surface of the blank adhesively securing the third vinyl sheet to the first planar surface of the blank, and the label overlaying the third vinyl sheet with the back surface of the first vinyl sheet of the label in contact with the front surface of the third vinyl sheet so that the label is removably held to the third vinyl sheet by an incumbent static charge between the back surface of the first vinyl sheet of the label and the front surface of the third vinyl sheet causing the first vinyl sheet of the label to cling by adhesion to the front surface of the third vinyl sheet.

BRIEF DESCRIPTION OF THE DRAWINGS

A better understanding of the present invention will be had upon reference to the following description in conjunction with the accompanying drawings, wherein like numerals refer to like parts throughout the several views and in which.

DETAILED DESCRIPTION OF THE PREFERRED EMBODIMENTS

Figure 1:
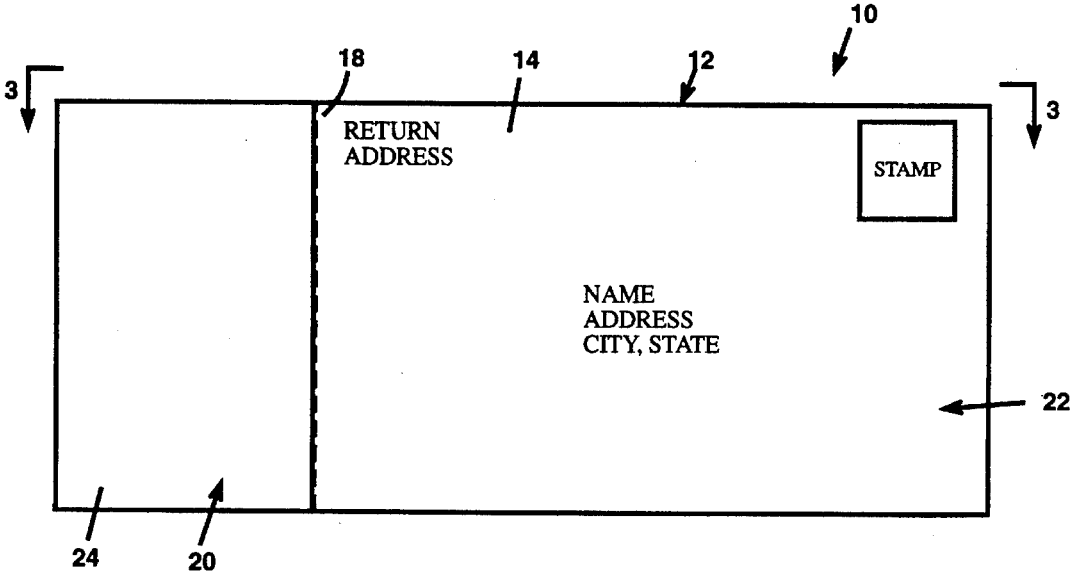
FIG. 1 is a front view of a post card incorporating features of the present invention.
Figure 2:
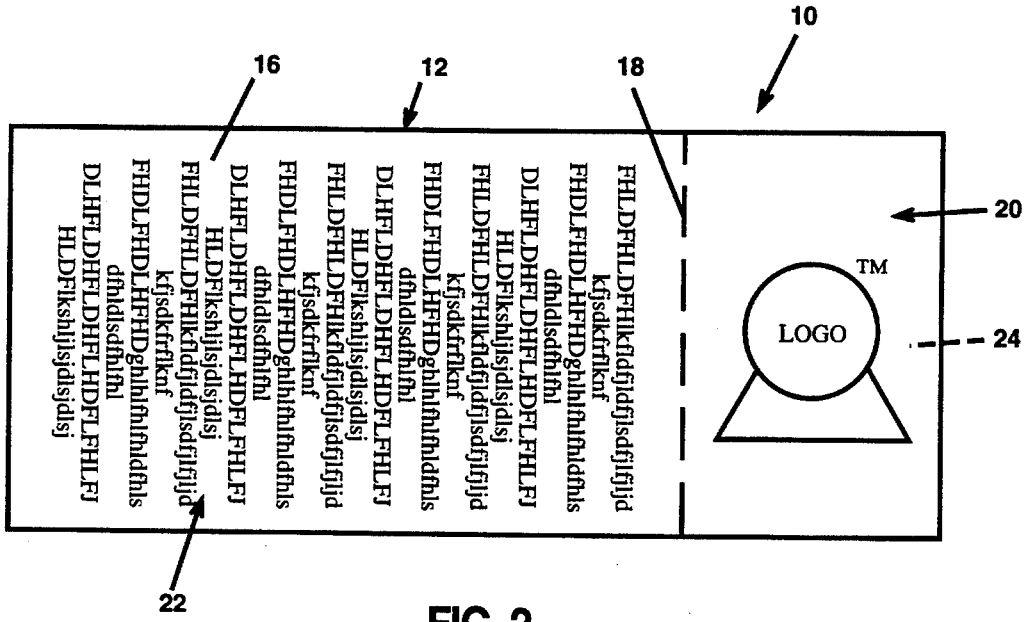
FIG. 2 is a back view of the post card of FIG. 1.
Figure 3:
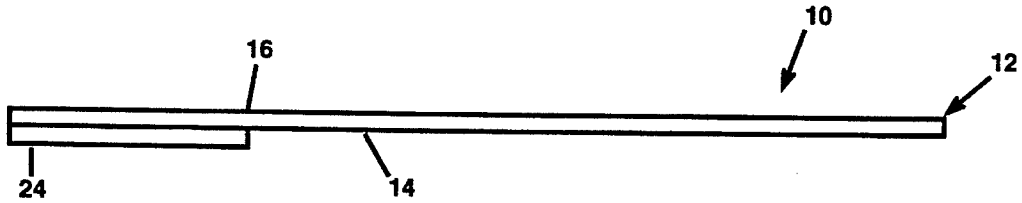
FIG. 3 is a side edge view of the post card of FIG. 1 as seen in the direction of arrows 3—3 in FIG. 1.

With reference to FIGS. 1–3, there is shown a post card, generally denoted as the numeral 10 of the present invention. The post card 10 is formed of a planar blank 12 having a first planar surface 14 and a second planar surface 16. The planar blank 12 is formed with a line of perforations 18 extending across the planar blank 12 dividing the planar blank into a first section 20 and a second section 22. The line of perforations provides for separating the first section 20 from the second section 22. A thin, flexible, magnetic sheet material 24 is adhesively secured to, for example, the first surface 14 of, for example, the first section 20. The thin, flexible, magnetic sheet material 24 is dimensionally coextensive with the first surface 14 of the first section 20. The first surface 14 of the second section 22 can be printed with indicia indicating the location of a postage stamp, location of addressee information, and location of return address information. The second surface 16 of the first section 20 as well as the second surface 16 of the second section 22 can be printed with indicia such as attractive art work, printed information, and the like.

The post card 10 can be magnetically secured to a magnetic surface, such as a refrigerator door or magnetic bulletin board, and the like, to display the card 10. Also, the first section 20 can be separated from the second section 22 along the line of perforations 18 and the separated first section 20 can then be magnetically secured to a magnetic surface, such as a refrigerator door or metallic bulletin board to display the indicia on the second surface 16 of the first section 20. Also, the first section 20 can be used to magnetically attach other sheets of paper, such as notes, to the magnetic surface.

The thin sheet of flexible magnetic material 24 is known and is a vinyl material including magnetic materials dispersed therethrough. Such a sheet of flexible magnetic material can be commercially purchased under the trademark "UltraMag" from Flex-Mag Industrial, Inc., a Division of Dynacast Co., Marietta, Ohio.

Figure 4:
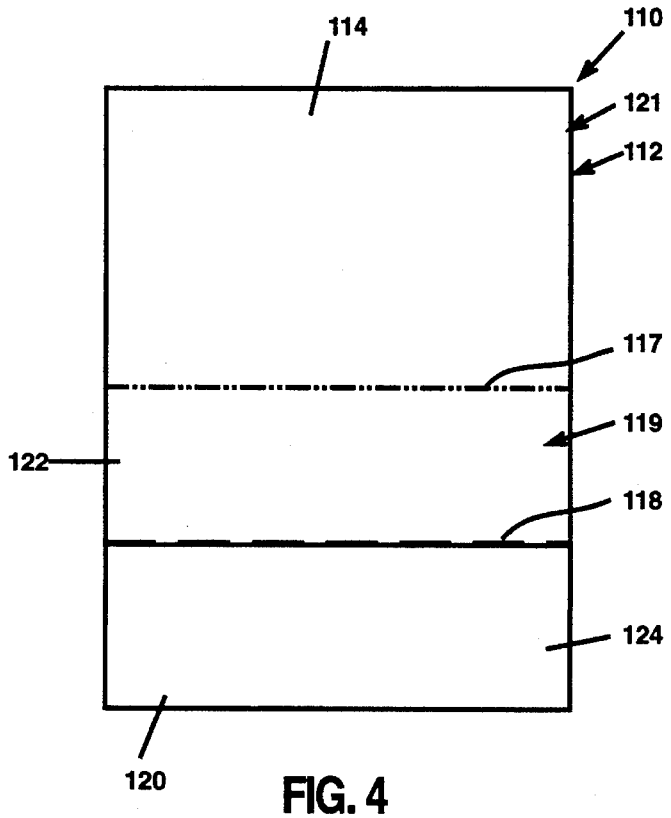
FIG. 4 is a front view of one embodiment of a greeting card incorporating features of the present invention.
Figure 5:
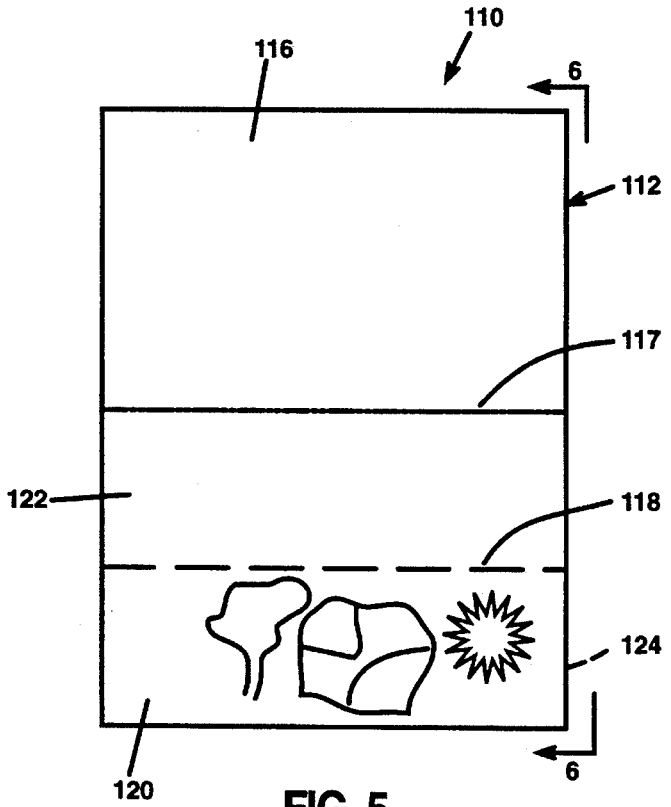
FIG. 5 is a back view of the greeting card of FIG. 4.
Figure 6:
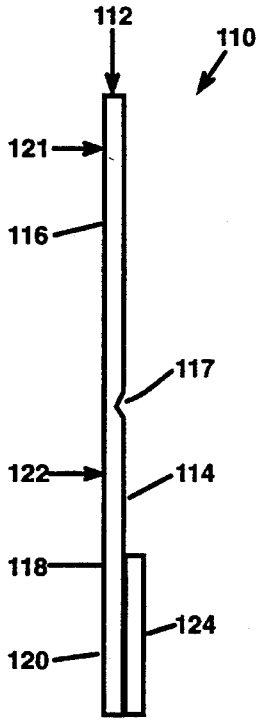
FIG. 6 is a side edge view of the greeting card of FIG. 4 as seen in the direction of arrows 6—6 in FIG. 5.

With reference to FIGS. 4–6, there is shown an embodiment of a greeting card, generally denoted as the numeral 110, of the present invention. The greeting card 110 is formed of a planar blank 112 having a first planar surface 114 and a second planar surface 116. The planar blank 112 is formed with a fold line 117 extending across the planar blank 112 dividing the planar blank 112 into a first portion 119 and a second portion 121. The first portion 119 can be folded relative to the second portion 121 into and out of overlaying relationship about the fold line 117. One portion, for example the first portion 119, can be formed with a line of perforations 118 extending across the first portion 119 generally parallel to the fold line 117 dividing the first portion 119 into a first section 120 and a second section 122. A thin, flexible, magnetic sheet material 124 is adhesively secured to, for example, the first surface 114 of, for example, the first section 120. The thin, flexible, magnetic sheet material 124 is dimensionally coextensive with the first surface 114 of the first section 120. The second surface 116 of the first section 120 as well as the second surface 116 of the second section 122 can be formed with indicia such as an attractive scene or art work and the like.

The entire greeting card 110 can be magnetically secured to a magnetic surface to display the entire card 110, or the first section 120 can be separated from the second section 122 along the line of perforations 118 and the separated first section 120 can be magnetically secured to a magnetic surface, such as a refrigerator door or metallic bulletin board, to display the indicia on the second surface 116 of the first section 120. Also, the first section 120 can be used to magnetically attach other sheets of paper, such as notes, and the like, to the magnetic surface.

Figure 7:
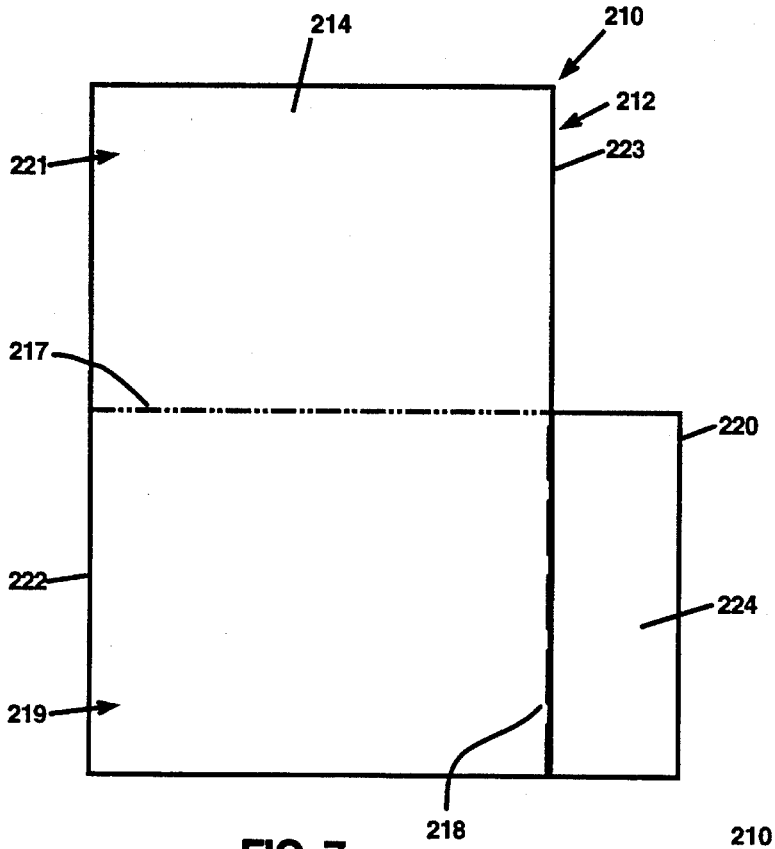
FIG. 7 is a front view of another embodiment of a greeting card incorporating features of the present invention.
Figure 8:
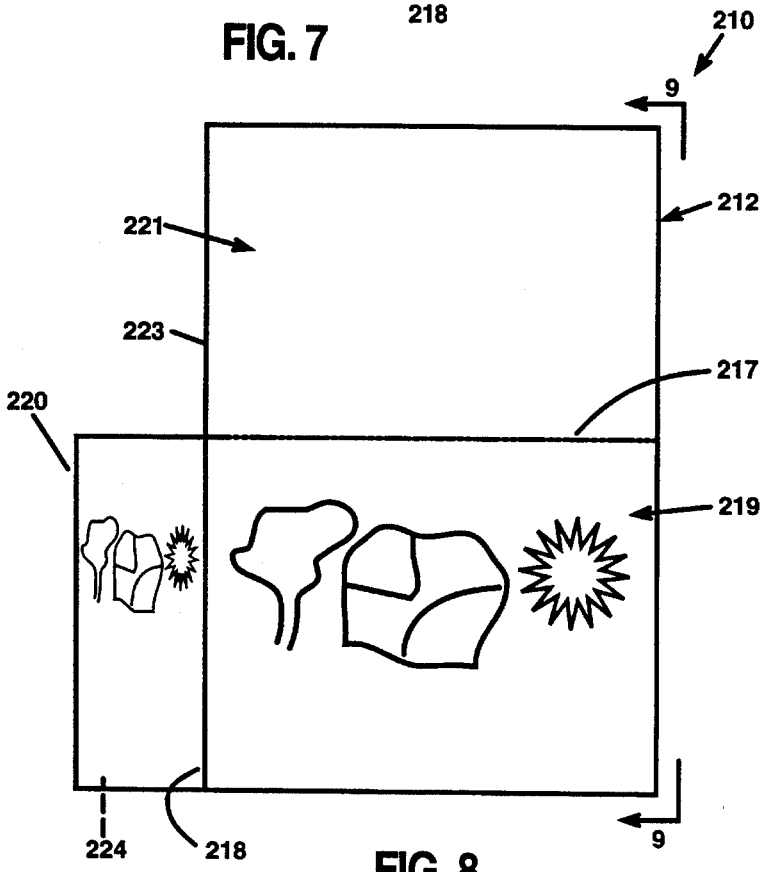
FIG. 8 is a back view of the greeting card of FIG. 7.
Figure 9:
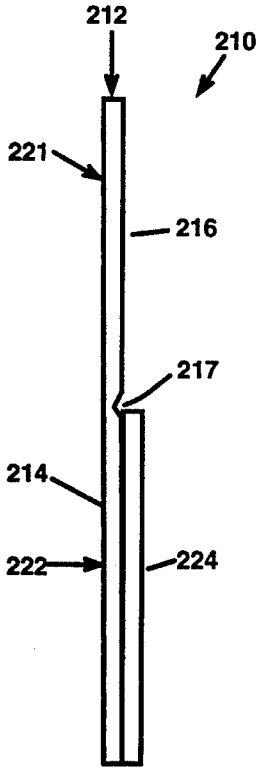
FIG. 9 is a side edge view of the greeting card of FIG. 7 as seen in the direction of arrows 9—9 in FIG. 8.

Now with reference to FIGS. 7–9, there is shown another embodiment of a greeting card, generally denoted as the numeral 210 of the present invention. The greeting card 210 is formed of a planar blank 212 having a first planar surface 214 and a second planar surface 216. The planar blank 212 is formed with a fold line 217 extending across the planar blank 212 dividing the planar blank 212 into a first portion 219 and a second portion 221. The first portion 219 can be folded relative to the second portion 221 into and out of mutual overlaying relationship about the fold line 217. One portion, for example the first portion 219, is wider than the second portion 221, and can be formed with a line of perforations 218 extending across the first portion 219 perpendicular to the fold line 217 and in alignment with the adjacent side edge 223 of the second portion 221 dividing the first portion 219 into a first section 220 and a second section 222. A thin, flexible, magnetic sheet material 224 is adhesively secured to, for example, the first surface 214 of, for example, the first section 220. The thin, flexible, magnetic sheet material 224 is dimensionally coextensive with the first surface 214 of the first section 220. The second surface 216 of the first section 220 as well as the second surface 216 of the second section 222 can be formed with indicia such as an attractive scene, art work, or writing, and the like.

The entire greeting card 210 can be magnetically secured to a magnetic surface to display the entire card 210, or the first section 220 can be separated from the second section 222 along the line of perforations 218 and the separated first section 220 can be magnetically secured to a magnetic surface, such as a refrigerator door or metallic bulletin board, to display the indicia on the second surface 216 of the first section 220. Also, the first section 220 can be used to magnetically attach other sheets of paper, such as notes and the like, to the magnetic surface.

Figure 10:
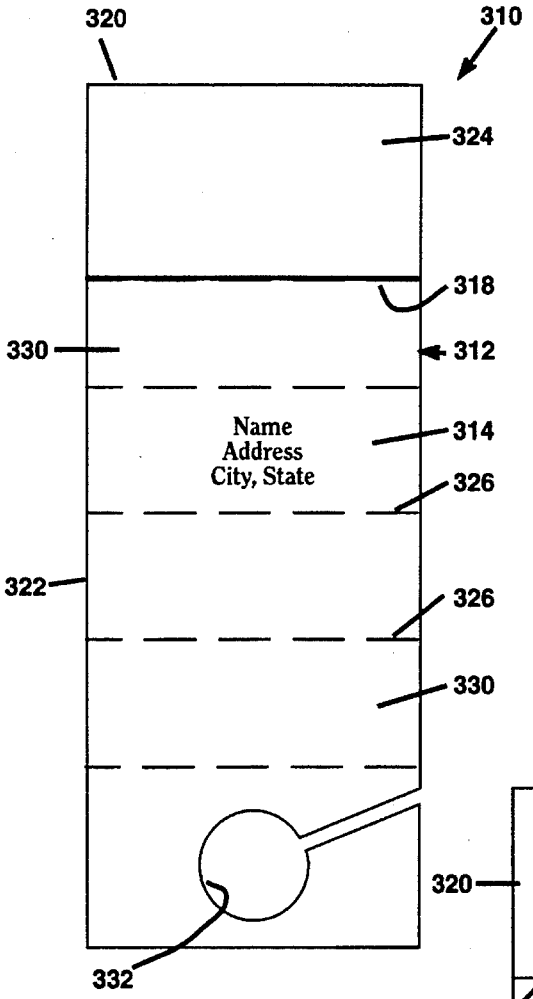
FIG. 10 is a front view of an advertising card incorporating features of the present invention.
Figure 12:
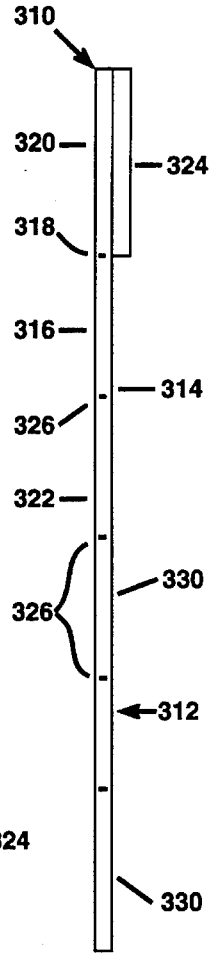
FIG. 12 is a side edge view of the advertising card of FIG. 10 as seen in the direction of arrows 12—12 in FIG. 11.
Figure 11:
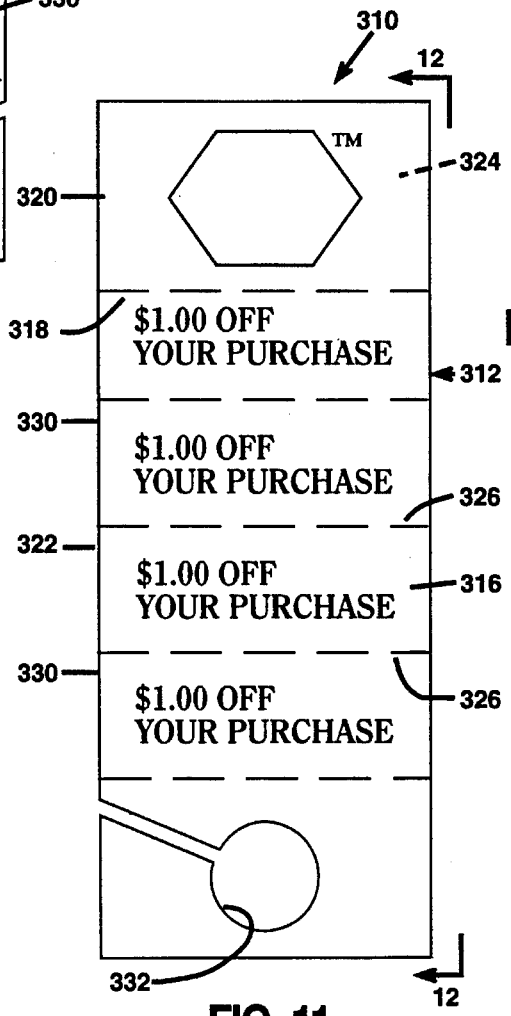
FIG. 11 is a back view of the advertising card of FIG. 10.
Figure 13:
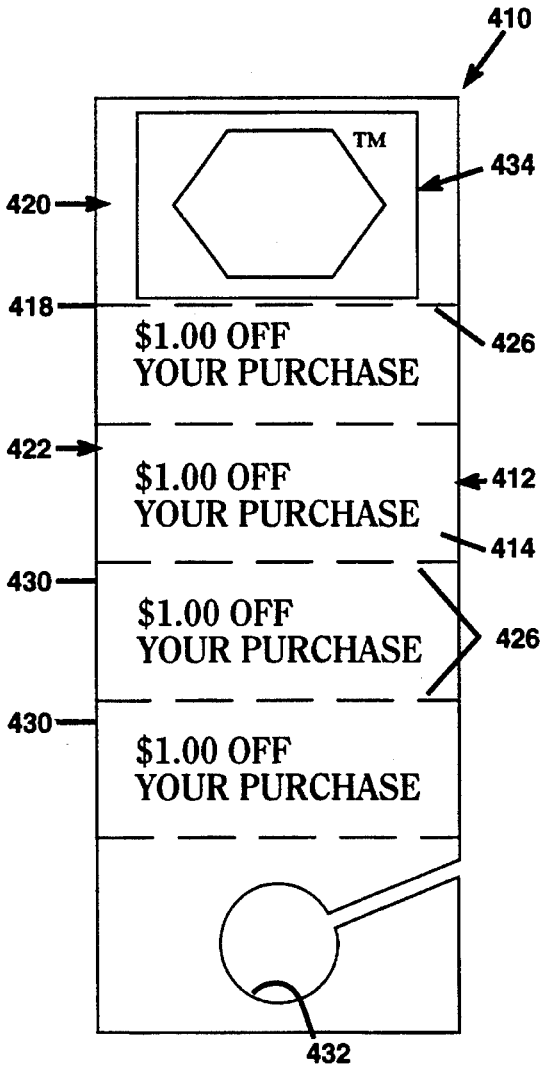
FIG. 13 is a front view of yet another embodiment of an advertising card incorporating features of the present invention.
Figure 14:
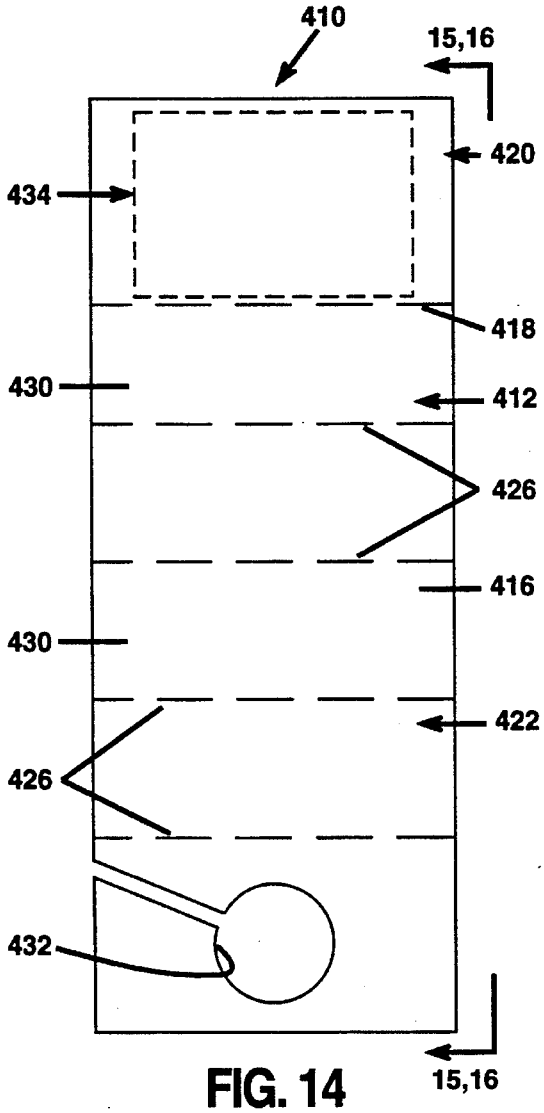
FIG. 14 is a back view of the advertising card of FIG. 13.

Turning now to FIGS. 10–12, there is shown an embodiment of an advertising card, generally denoted as the numeral 310 of the present invention. The advertising card 310 is formed of a planar blank 312 having a first planar surface 314 and a second planar surface 316. The planar blank 312 is formed with a line of perforations 318 extending across the planar blank 312 dividing the planar blank into a first section 320 and a second section 322. The line of perforations 318 provides for separating the first section 320 from the second section 322. A thin, flexible magnetic sheet material 324 is adhesively secured to, for example, the first surface 314 of, for example, the first section 320. The thin, flexible, magnetic sheet material 324 is dimensionally coextensive with the first surface 314 of the first section 320. The second surface 316 of the first section 320 can be printed with indicia such as a business trademark or service mark, for example. The second section 322 can be formed with second perforated lines 326 defining a plurality of subsections 330 which can be individually separated along the perforated lines 326. The second surface 316 of the subsections 330 can be printed with indicia representing, for example, promotional purchase coupons. Also, the first surface 314 of the second section 322 can be printed with indicia.

The advertising card 310 can be used as a mailer, an insert in newspapers or magazines, or as a door hanger to be hung on home doors. In the event the advertising card 310 is used as mailer, the front surface 314 second section 322 can be printed with addressee information and include an area for postage. In the event that the adverting card 310 is to be used as a door hanger, the second section 322 can be formed with a cut-out 332 to receive a door knob.

The advertising card 310 can be magnetically secured to a magnetic surface, such as a refrigerator door or metallic bulletin board, to promotionally display the purchase coupons 330. Also, when the coupons 330 have been used, the first section 320 can be separated along the line of perforations 318. The separated first section 320 can be magnetically secured to a magnetic surface, such as a refrigerator door or metallic bulletin board to magnetically attach other sheets of paper, such as notes and the like, to the magnetic surface while showing the trademark or service mark on the first section 320.

Figure 15:
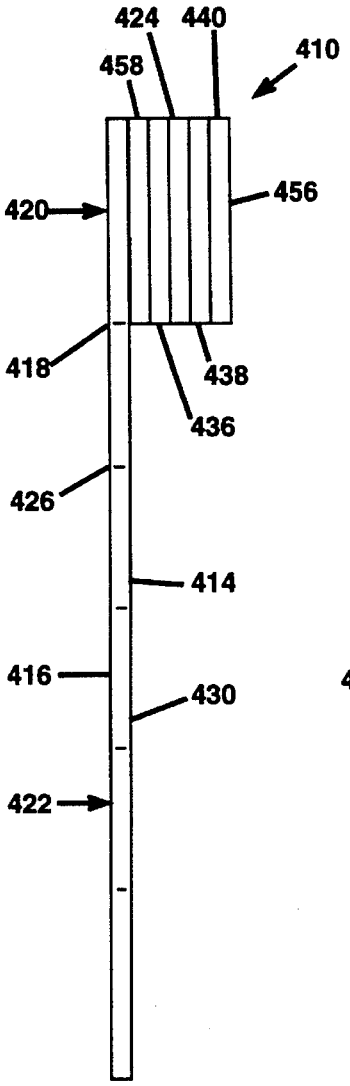
FIG. 15 is a side edge view of the advertising card of FIG. 13 as seen in the direction of arrows 15—15 in FIG. 14; and, FIG. 16 is an enlarged, exploded side edge view of a portion of the card of FIG. 13 as seen in the direction of arrows 16—16 in FIG. 14.
Figure 16:
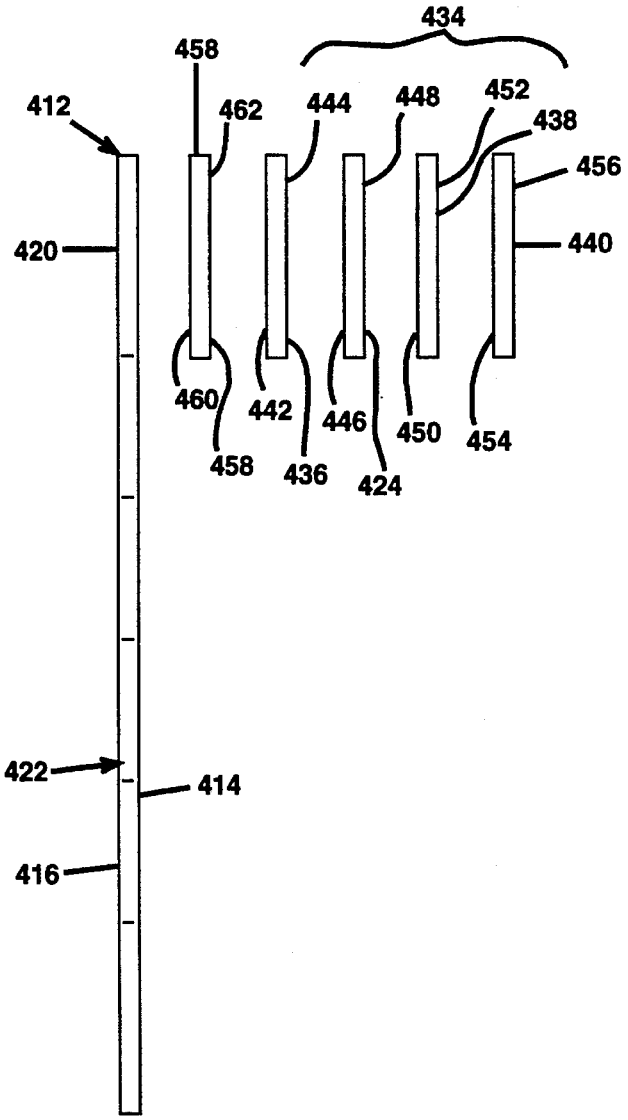

Now turning to FIGS. 13–16, there is shown another embodiment of an advertising card, generally denoted as the numeral 410 of the present invention. The advertising card 410 is formed of a planar blank 412 having a first planar surface 414 and a second planar surface 416. The advertising card 410 further comprises a magnetized label, generally denoted as the numeral 434, removably adhered to the first planar surface 414 of the blank 412. In FIGS. 15 and 16, the thickness of the label 412 is exaggerated to clearly show its various components. The magnetized label 434 comprises a first sheet or layer of vinyl 436, a thin sheet of flexible magnetic material 424, a sheet or layer of double-backed tape 438, and a second sheet or layer of vinyl 440. The first sheet of vinyl 436 has a back surface 442 and a front surface 444 with a pressure-sensitive adhesive coating only the back surface 442. The sheet of flexible magnetic material 424 has a back surface 446 and a front surface 448, and is substantially identical in peripheral shape with the peripheral shape of the first vinyl sheet 436. The magnetic material sheet 424 overlays the first vinyl sheet 436 with the back surface 446 of the magnetic sheet 424 in registered contact with the front surface 444 of the first vinyl sheet 436 so that the magnetic sheet 424 is adhesively secured to the front surface of the first vinyl sheet 436. The sheet of tape 438 has a back surface 450 and a front surface 452, and is substantially identical in peripheral shape with the peripheral shape of the magnetic sheet 424. Both the back surface 450 and front surface 452 of the tape sheet 438 are coated with an adhesive material. The tape sheet 438 overlays the magnetic sheet 424 with the back surface 450 of the tape sheet 438 in registered contact with the front surface 448 of the magnetic sheet 424 so that the tape sheet 438 is adhesively secured to the front surface 448 of the magnetic sheet 424. The second vinyl sheet 440 has a back surface 454 and a front surface 456, and is substantially identical in peripheral shape with the peripheral shape of the tape sheet 438. Indicia, such as a business trademark or service mark is printed on the second vinyl sheet 440. The second vinyl sheet 440 overlays the tape sheet 438 with the back surface 454 of the second vinyl sheet 440 in registered contact with the front surface 452 of the sheet of tape 438 so that the second vinyl sheet 440 is adhesively secured to the tape sheet 438.

With continued reference to FIGS. 13 through 16, the magnetic label 434 is removably held by adhesion to the planar blank 412 by means of a third sheet or layer of vinyl 458. The third sheet of vinyl 458 has a back surface 460 and a front surface 462, and is substantially identical in peripheral shape with the peripheral shape of the first vinyl sheet 436 of the label 434. A pressure-sensitive adhesive coating covers only the back surface 460 of the third vinyl sheet 458. The third vinyl sheet 458 overlays a portion of the first planar surface 414 of the planar blank 412 with the back surface 414 of the third vinyl sheet 458 in contact with the first planar surface 414 of the blank 412. The label 434 overlays the third vinyl sheet 458 with the back surface 442 of the first vinyl sheet 436 of the label 434 in contact with the front surface 462 of the third vinyl sheet 458 so that the label 434 clings to the third vinyl sheet by adhesion or an incumbent mutually attractive force, to hold the label 434 to the third vinyl sheet 458 by a static charge incumbent between the back surface 460 of the first vinyl sheet 436 and the front surface 462 of the third vinyl sheet 458.

The advertising card 410 can be magnetically secured to a magnetic surface. Also, the magnetic label 434 can be easily separated from the planar blank 412 by merely peeling the label 434 from the third vinyl sheet 458. The separated magnetic label 434 can be magnetically secured to a magnetic surface, such as a refrigerator door or a metallic bulletin board, to display the indicia on the second vinyl sheet 440. Also, the magnetic label 434 can be used to magnetically attach other sheets of paper, such as notes and the like, to the magnetic surface.

The planar blank 412 can be formed with a perforated line 418 dividing the blank 412 into a first section 420 and a second section 422. The magnetic label 434 can be located on the first surface 414 of the first section 420, and the second section 422 can be formed with perforated lines 426 defining a plurality of sub-sections 430 which can be individually separated along the perforated lines 426. These subsections 430 can be printed on the first surface 414 with indicia representing, for example, promotional purchase coupons.

The foregoing detailed description is given primarily for clearness of understanding and no unnecessary limitations are to be understood therefrom for modifications will become obvious to those skilled in the art upon reading this disclosure and may be made without departing from the scope of the inventions or scope of the appended claims.

I claim:

1. A card comprising:

a planar blank, said planar blank having a first planar surface and a second planar surface, said planar blank having at least one line of perforations dividing said planar blank into a first section and a second section; and, a thin, flexible, magnetic sheet material having magnetic materials therein, said magnetic sheet material being capable of magnetically holding said card to a magnetic substance, said magnetic sheet material being secured to said first planar surface within said first section; where said first section of said card having said magnetic sheet material secured thereto can be separated from said second section of said card along said at least one line of perforations.

2. The card of claim 1, where said first section has a length and a width and where said magnetic sheet material is generally dimensionally coextensive with said length and said width of said first section.

3. The card of claim 2, where said second section includes at least one line of perforations for separating said second section into a plurality of subsections.

4. The card of claim 3, where said at least one line of perforations for separating said second section into a plurality of subsections comprises at least a first line of perforations and a second line of perforations.

5. The card of claim 1, further comprising indicia printed on at least said first section on said second planar surface.

6. The card of claim 1, further comprising indicia printed on at least said second section of said second planar surface.

7. The card of claim 1, further comprising indicia printed on said second planar surface.

8. The card of claim 1, where said magnetic sheet material is adhesively secured to said first planar surface within said first section.

9. The card of claim 1, further comprising mailing indicia on said first planar surface within said second section.

10. The card of claim 1, where said second section includes at least one line of perforations for separating said second section into a plurality of subsections.

11. The card of claim 10, where said at least one line of perforations for separating said second section into a plurality of subsections comprises at least a first line of perforations and a second line of perforations.

12. The card of claim 1, where said second section includes an opening therethrough for hanging said card on a door knob.

* * * * *

US005458282B1

REEXAMINATION CERTIFICATE (3385th)

United States Patent [19]

Martin

[11] B1 5,458,282

[45] Certificate Issued Nov. 18, 1997

[54] CARD HAVING MAGNETIC SHEET SECURED TO ONE SURFACE

[75] Inventor: John J. Martin, Louisville, Ky.

[73] Assignee: Crane Productions, Inc.

Reexamination Request:
No. 90/004,508, Jan. 8, 1997

Reexamination Certificate for:

| | |
|---|---|
| Patent No.: | **5,458,282** |
| Issued: | **Oct. 17, 1995** |
| Appl. No.: | **915,537** |
| Filed: | **Jul. 20, 1992** |

[51] Int. Cl.[6] ..... B42D 15/02

[52] U.S. Cl. ..... 229/92.8; 283/56

[58] Field of Search ..... 206/818; 40/124.04, 40/711, 661.01; 428/900

[56] References Cited

U.S. PATENT DOCUMENTS

| | | | |
|---|---|---|---|
| 1,264,795 | 4/1918 | Hill | 229/92.8 |
| 2,805,816 | 9/1957 | Morgan | 229/92.8 |
| 4,887,763 | 12/1989 | Sano | 229/92.8 |
| 4,957,311 | 9/1990 | Geisenheimer | 283/56 |
| 5,036,310 | 7/1991 | Russell | 340/569 |
| 5,085,470 | 2/1992 | Peach et al. | 283/58 |

OTHER PUBLICATIONS

The 1990 catalog of Magnet, Inc., with particular reference to pp. 16, 17, 27 and 32.

A 1990 promoptional mailer of Magnet, Inc.

*Primary Examiner*—Stephen P. Garbe

[57] ABSTRACT

A card fabricated of a flexible material such as paper, pasteboard, plastic and the like that has a first planar surface and a second planar surface. The card is formed with a line of perforations or a fold line dividing the card into first and second sections and a thin, flexible, magnetic sheet material is adhesively secured to one of the planar surfaces of one of the sections. The thin, flexible, magnetic sheet is dimensionally coextensive with the section to which it is attached. Indicia is printed on the exposed surface of the card section to which the magnetic sheet is secured.

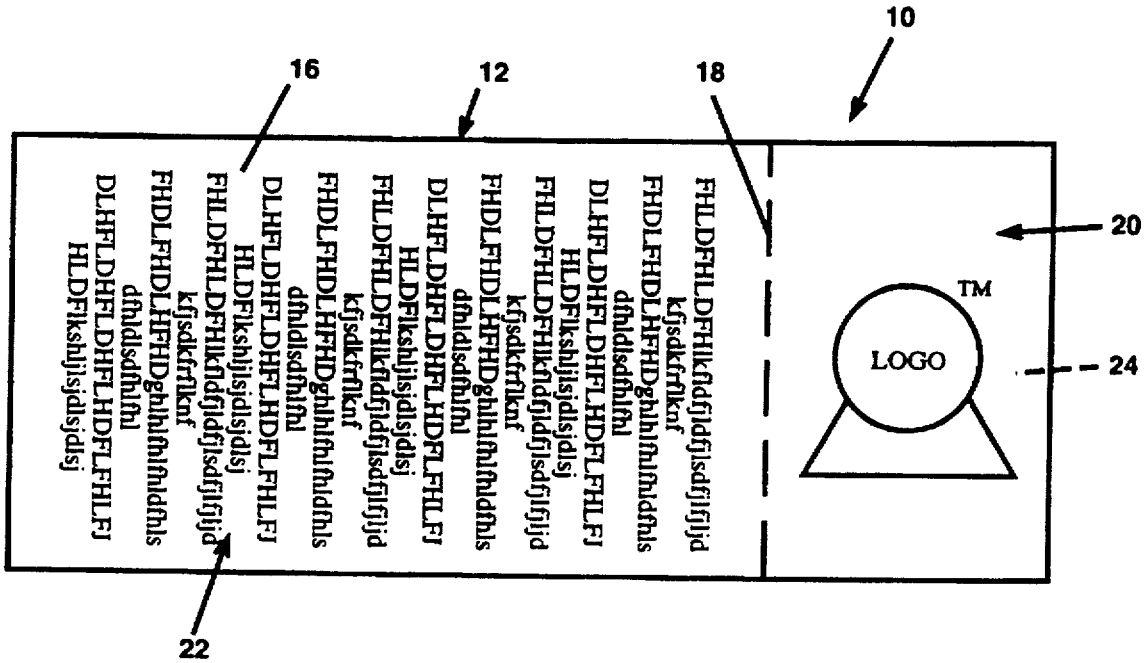

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–12, dependent on an amended claim, are determined to be patentable.

New claims 13–17 are added and determined to be patentable.

1. A card, comprising:

a planar blank, said planar blank having a first planar surface and a second planar surface, *said planar blank having a first edge and an opposed second edge and a third edge and an opposed fourth edge*, said planar blank having at least one line of perforations dividing said planar blank into a first section and a second section; and, a thin flexible, magnetic sheet material having magnetic materials therein, said magnetic sheet material being capable of magnetically holding said card to a magnetic substance, said magnetic sheet material being secured to said first planar surface within said first section *and contained entirely therewithin and defining an exterior surface, said magnetic sheet material extending substantially from said third edge of said blank to said opposed fourth edge of said blank and substantially from said first edge partways toward said opposed second edge*; where said first section of said card having said magnetic sheet material secured thereto can be separated from said second section of said card along said at least one line of perforations.

*13. The card of claim 1, where said at least one line of perforations extends from said third edge of said planar blank.*

*14. The card of claim 1, where said at least one line of perforations extends from said third edge to said opposed fourth edge of said planar blank.*

*15. A card, comprising:*

*a planar blank, said planar blank having a first planar surface and a second planar surface, said planar blank having a first edge and an opposed second edge and a third edge and an opposed fourth edge, said planar blank having at least one line of perforations dividing said planar blank into a first section and a second section; and, a thin flexible, magnetic sheet material having magnetic materials therein, said magnetic sheet material being capable of magnetically holding said card to a magnetic substance, said magnetic sheet material being secured to said first planar surface within said first section and defining an exterior surface, said magnetic sheet material extending substantially from said third edge of said blank to said opposed fourth edge of said blank and substantially from said first edge partways toward said opposed second edge, where a substantial portion of said first planar surface of said planar blank is free of said magnetic sheet material; where said first section of said card having said magnetic sheet material secured thereto can be separated from said second section of said card along said at least one line of perforations.*

*16. The card of claim 15, where said at least one line of perforations extends from said third edge of said planar blank.*

*17. The card of claim 15, where said at least one line of perforations extends from said third edge to said opposed fourth edge of said planar blank.*

* * * * *